United States Patent [19]

Judge

[11] Patent Number: 4,705,194

[45] Date of Patent: Nov. 10, 1987

[54] TOOTHBRUSH HOLDER ATTACHMENT FOR TOOTHPASTE TUBES

[76] Inventor: Joseph Judge, 1660 E. 12th St., Brooklyn, N.Y. 11229

[21] Appl. No.: 941,068

[22] Filed: Dec. 12, 1986

[51] Int. Cl.[4] ..... A47G 29/08; B67D 5/06

[52] U.S. Cl. ..... 222/192; 211/65; 222/93; 248/110

[58] Field of Search ..... 222/93, 94, 105, 106, 222/173, 180, 129, 130, 143, 383, 340, 530, 538, 539, 566, 567, 569, 570; 132/84 R, 84 D; 248/108–113, 311.2, 311.3, 312, 360; 211/65, 66; 206/362.1, 362.2, 15.2, 15.3; D9/302, 337, 434

[56] References Cited

U.S. PATENT DOCUMENTS

| | | | |
|---|---|---|---|
| 971,818 | 10/1910 | Barker | 222/93 |
| 1,005,985 | 10/1911 | Lebherz | 211/65 X |
| 1,501,656 | 7/1924 | Gilda | 222/93 |
| 2,906,479 | 9/1959 | Strachan | 211/65 X |
| 2,937,790 | 5/1960 | Lapeyre | 222/94 |
| 3,155,279 | 11/1964 | Ferguson, Jr. | 222/93 |
| 3,275,195 | 9/1966 | Reinstra | 222/105 X |
| 3,586,212 | 6/1971 | Tzouras | 222/93 |
| 4,020,975 | 5/1977 | Stauffer | 222/105 X |
| 4,402,431 | 9/1983 | Wiegner et al. | 222/383 X |
| 4,508,239 | 4/1985 | Rozzen | 222/93 X |
| 4,508,303 | 4/1985 | Becker, Jr. | 248/311.2 |
| 4,646,999 | 3/1987 | Clark | 248/360 |
| 4,673,106 | 6/1987 | Fishman | 222/391 X |

*Primary Examiner*—Joseph J. Rolla
*Assistant Examiner*—Kevin P. Shaver
*Attorney, Agent, or Firm*—James W. Fitzsimmons; Warren N. Low; Renee S. Rutkowski

[57] ABSTRACT

An attachment for a non-collapsible toothpaste tube which when mounted on the toothpaste tube becomes an integral toothbrush holder. The holder attachment is particularly adapted for use with a toothpaste container having a cavity therein for carrying the attachment prior to utilization of the attachment to store or hold toothbrushes.

5 Claims, 5 Drawing Figures

10
18
T
6
4
8
2
16
14
12
1
21
23
22
20
27
24
26
28
34
32
30
36
38

TOOTHBRUSH HOLDER ATTACHMENT FOR TOOTHPASTE TUBES

SUMMARY

This invention relates generally to an attachment intended to be mounted on a pump type non-collapsible tooth paste tube.

My discovery is a practical and useful attachment to assist in marketing tooth paste analogous to a measuring cup found commonly in cans of ground coffee.

Admittedly, a attachment which I have invented is without function standing alone, but when mounted on a non-collapsibe tooth paste tube it gains an identity as a tooth brush holder, a need for which need not be explained.

OBJECT OF INVENTION

It is a first object of this invention to provide an attachment for a non-collapsible tooth paste tube which when mounted on the tube becomes an integral tooth brush holder.

It is a further object of this invention to provide a replacement attachment for the threaded cap included with pump type non-collapsible tooth paste tubes which when assembled on the tube threads becomes an integral tooth brush holder.

It is a still further object of this invention to provide an attachment for a non-collapsible tooth paste which is structured inherently to be affixed to the tube to provide, when mounted thereon, an integral tooth brush holder.

DETAILED DESCRIPTION OF A PREFERRED EMBODIMENT OF THE INVENTION

Figures 1, 2, 3, 4, 5:
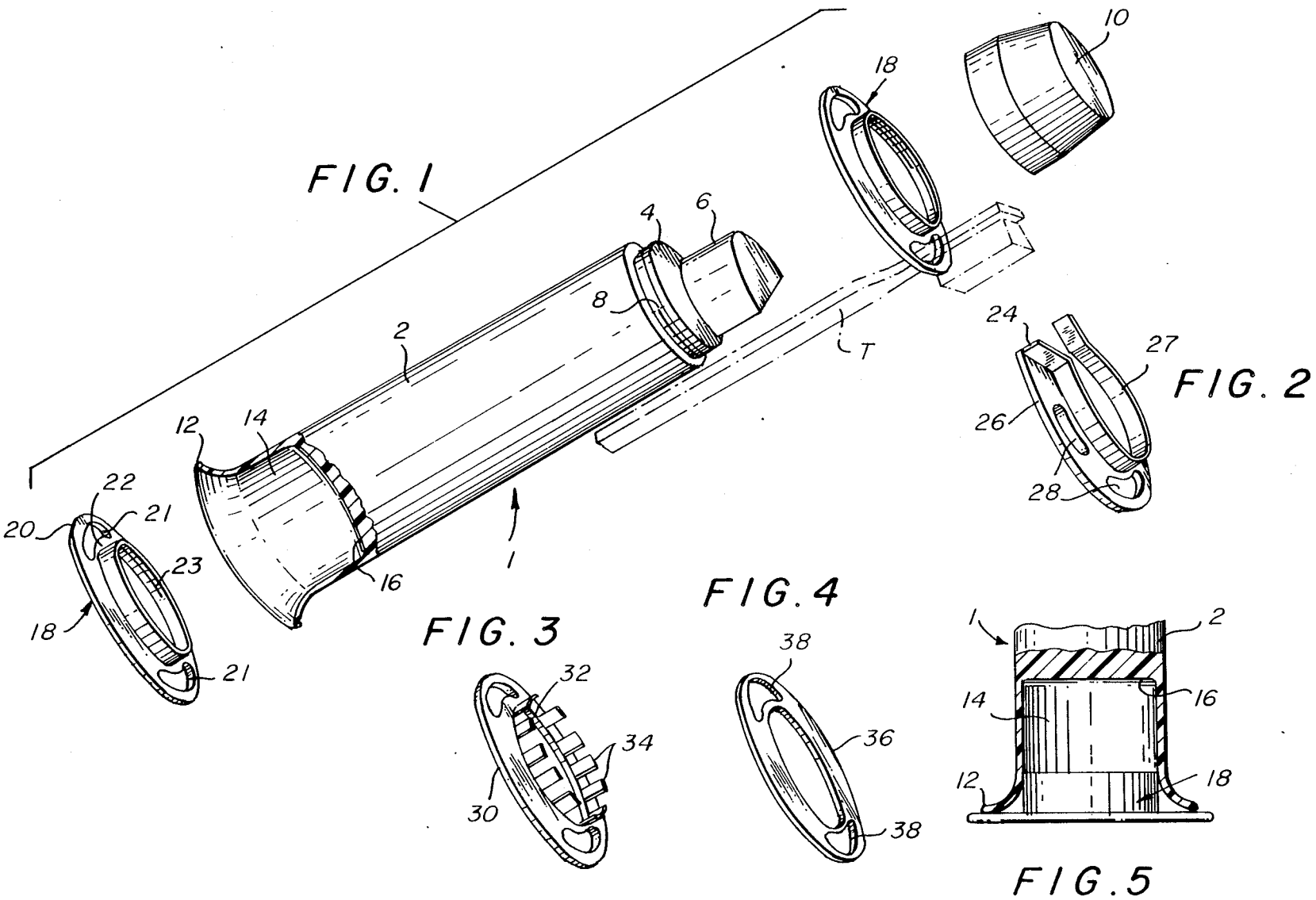
FIG. 1 is a perspective view exploded to show the removed cap that is supplied with a non-collapsible tooth paste tube and one form of the replacement attachment which is the subject matter of this invention.
FIG. 2 is a perspective view of an embodiment of my invention showing the attachment in the form of a horseshoe type spring clip.
FIG. 3 is a perspective view of an embodiment of my invention showing the attachment in the form of a ring with upended spring fingers to frictionally secure the attachment to the tube.
FIG. 4 is a perspective view of an embodiment of my invention where it is made of resilient material such as plastic for a frictional fit about the tube.
FIG. 5 is a fragmentary sectional elevation of the attachment of FIG. 1 showing the same in stored position within the bottom cavity of the container.

With reference to the drawings—and particularly FIG. 1—a commercial non-collapsible tooth paste tube is shown as comprising a body 2, a neck 4 and a dispenser 6. The neck is provided with threads 8 to accommodate an over cap 10 which has matching internal threads not shown for threaded engagement with the threads 8 on shoulder 4 to enclose the dispenser 6.

Tube 2 also has a flanged or flared bottom 12 attached to and a part of body 2 to provide stability when the tube is placed upright on a horizontal surface.

In a usual embodiment the tube 1 also provides an internal cavity 14 to provide a false bottom or recess; ie: the end or bottom 16 of the tube 2 is raised from the plane of the flanged bottom 12—which is significant in that it can provide a storage chamber for some forms of my attachment during the merchandising period of the toothpaste tube—as will be later demonstrated.

In a preferred embodiment of my invention I provide a molded attachment 18 which comprises a base planar ring 20 having a diameter slightly larger than flange 12. The planar ring is provided with a number of apertures of a size to accommodate a tooth brush handle. In addition an upstanding collar 22 is integrally formed to the planar ring 20. The collar has an external dimension which permits it to be inserted into the cavity 14 for a friction fit of the external annular portion of the collar with the cylindrical sidewall of the container recess, while threads 23 are provided on its inner annular surface to permit its engagement with the threads 8 on neck 4 of the tube.

Ideally then the non-collapsible tooth paste tube is merchandized with the tooth brush holder 18 snapped into the cavity 14 for storage as seen in FIG. 5. The purchaser, when he intends to use the tooth paste, removes the cap 10 and replaces it with attachment 18 and he then has a non-collapsible tooth paste tube and integral tooth brush holder.

In alternate forms the attachment can be:

(a) In the form of a horseshoe type spring, as shown in FIG. 2. The spring 24 has a planar surface 26 provided with apertures 28 to hold a tooth brush handle. The inner diameter of the spring 24 is such that the spring can be spread enough to permit its being installed over the tube and then grip it frictionally to hold it in place on the tube.

(b) In the form of a plane 30 having an upstanding inner collar 32 defining an annular series of spring clip fingers 34 which frictionally engage the outer diameter of the non-collapsible tooth paste tube. In this embodiment the fingers can provide the second function of snapping into the bottom cavity 14 of the tooth paste tube for storage during merchandising.

(c) In the form of a plastic ring which lies in a single plane and which is provided with apertures 38 to accommodate toothbrush handles and an inner opening to provide a stretch fit over the non-collapsible tube and then be frictionally held in place to provide the integral tooth brush holder.

While several embodiments of my invention have been described for use with a non-collapsible tooth paste tube it will be obvious to those skilled in the art that my invention is applicable to other products and other uses and to protect my invention and its modifications I claim:

1. A cylindrical walled toothpaste container in combination with a detachable toothbrush holder;

said toothpaste container having a base permitting free-standing of the container, the base of the container being open and the cylindrical wall of the container together with said open base defining a cavity;

said toothbrush holder comprising: a substantially annular portion and a toothbrush holding means for holding toothbrushes, said toothbrush holding means extending outwardly from said annular portion, said annular portion having an inside surface for engagement with an external portion of the container for mounting the holder thereon in a toothbrush and an outside surface for frictional engagement with an internal surface of the cylindrical wall of the container within said cavity for storing said toothbrush holder in a position of non-use.

2. The toothpaste container and toothbrush holder of claim 1 wherein said annular portion comprises a series of longitudinally extending tongues.

3. The toothpaste container and toothbrush holder of claim 1 wherein said inside surface of said annular portion includes screw threads, and said external portion of said container includes screw threads cooperating therewith.

4. The toothpaste container and toothbrush holder of claim 1 wherein said toothbrush holding means is an apertured substantially planar ring surrounding said annular portion.

5. The toothpaste container and toothbrush holder of claim 4 wherein said base is outwardly flared from the container to enhance the free-standing stability thereof, and said toothbrush holder substantially overlying said flared base when said toothbrush is received in said cavity.

* * * * *

UNITED STATES PATENT AND TRADEMARK OFFICE

CERTIFICATE OF CORRECTION

PATENT NO. : 4,705,194

DATED : November 10, 1987

INVENTOR(S) : Joseph Judge

It is certified that error appears in the above-identified patent and that said Letters Patent is hereby corrected as shown below:

Claim 1, at line 65 of column 2 should read:

--- container for mounting the holder thereon in position to receive a ---

Signed and Sealed this

Eleventh Day of April, 1989

*Attest:*

*Attesting Officer*

DONALD J. QUIGG

*Commissioner of Patents and Trademarks*